US009459039B2

(12) United States Patent
Koike et al.

(10) Patent No.: US 9,459,039 B2
(45) Date of Patent: Oct. 4, 2016

(54) OUTDOOR UNIT OF AIR CONDITIONING DEVICE

(71) Applicant: DAIKIN INDUSTRIES, LTD., Osaka-shi, Osaka (JP)

(72) Inventors: Fumiaki Koike, Sakai (JP); Mikio Kagawa, Sakai (JP); Shigeki Kamitani, Sakai (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 243 days.

(21) Appl. No.: 14/361,349

(22) PCT Filed: Oct. 12, 2012

(86) PCT No.: PCT/JP2012/076401
§ 371 (c)(1),
(2) Date: May 29, 2014

(87) PCT Pub. No.: WO2013/080682
PCT Pub. Date: Jun. 6, 2013

(65) Prior Publication Data

US 2014/0318173 A1 Oct. 30, 2014

(30) Foreign Application Priority Data

Nov. 30, 2011 (JP) ..... 2011-261114

(51) Int. Cl.

| | |
|---|---|
| ***F25D 17/06*** | (2006.01) |
| ***F25D 23/00*** | (2006.01) |
| ***F24F 1/56*** | (2011.01) |
| ***F24F 13/20*** | (2006.01) |
| ***F24F 1/50*** | (2011.01) |

(52) U.S. Cl.
CPC ..... *F25D 23/003* (2013.01); *F24F 1/50* (2013.01); *F24F 1/56* (2013.01); *F24F 13/20* (2013.01); *F24F 2013/202* (2013.01); *F24F 2221/32* (2013.01)

(58) Field of Classification Search
CPC ..... F24F 5/0017; F24F 1/0007; F25B 1/10; F25B 13/00; F25B 40/00
USPC ..... 62/426, 262, 297, 498, 513
See application file for complete search history.

(56) References Cited

U.S. PATENT DOCUMENTS 5,638,693 A * 6/1997 Baek ..... F24F 13/20 312/400
6,085,537 A 7/2000 Takeda et al.

FOREIGN PATENT DOCUMENTS

| | | |
|---|---|---|
| JP | 56-74226 | 6/1981 |
| JP | 56-144271 | 10/1981 |
| JP | 57-9727 | 1/1982 |
| JP | 62-105434 | 7/1987 |

(Continued)

*Primary Examiner* — Melvin Jones
(74) *Attorney, Agent, or Firm* — Birch, Stewart, Kolasch & Birch, LLP

(57) ABSTRACT

An outdoor unit of an air conditioning device in which a compressor, a heat exchanger, and a fan are accommodated in a casing including a top plate, side plates, and a bottom plate is provided. The top plate is formed in a rectangular shape, and a flat mount surface is formed in each of corner portions of the top plate. Regarding each of sides of the top plate, an intermediate part excluding the corner portions serves as a retreat portion set back to the side of the device, and an end of the retreat portion and the mount surface are connected by a standing surface.

5 Claims, 10 Drawing Sheets

(56) References Cited

FOREIGN PATENT DOCUMENTS

| | | | |
|---|---|---|---|
| JP | 10-220816 | A | 8/1998 |
| JP | 10-267328 | A | 10/1998 |
| KR | 10-2005-0057906 | A | 6/2005 |

* cited by examiner

OUTDOOR UNIT OF AIR CONDITIONING DEVICE

TECHNICAL FIELD

The present invention relates to an outdoor unit of an air conditioning device. In further detail, the present invention relates to an outdoor unit of an air conditioning device in which a structure of a top plate of a casing of the outdoor unit is improved.

BACKGROUND ART

An outdoor unit of an air conditioning device is generally formed in a rectangular parallelepiped shape, in which a compressor, an outdoor heat exchanger, and the like are accommodated in a casing manufactured by a steel plate. The casing has a top plate, side plates, and a bottom plate. In an outdoor unit of a relatively large air conditioning device for a business use, the top plate and the like are attached to a frame (framework) including support pillars and lateral members by securing means such as a screw and a bolt.

In a case where such a plurality of outdoor units are transported or stored, the outdoor units are sometimes set closely to each other for effectively utilizing a space. In this case, in order to prevent damage to a grille protruding outward from an outer surface of the casing or the like and to prevent damage to the casing of the adjacent outdoor unit or the like by a head part of the bolt or the like, a buffer member formed by a molded body of styrene foams or the like is arranged between the adjacent outdoor unit and the outdoor unit.

However, in the conventional outdoor unit, the head part of the bolt or the like protrudes outward from the outer surface of the casing. Thus, there is a need for forming a part for absorbing (accommodating) this in the buffer member. Therefore, a shape of the buffer member becomes complicated, so that a cost increase is caused.

Thus, in order to prevent the head part of the screw or the bolt from being butted with the casing of the adjacently arranged outdoor unit, it is thought that an inclined surface is formed in an edge of the top plate of the casing and an insertion hole of the screw or the bolt is formed in this inclined surface. In addition, although the purpose is different, there is known an outdoor unit in which a fixing portion of a screw is provided in an inclined surface of a top plate (for example, refer to Patent Literature 1).

CITATION LIST

Patent Literature

Patent Literature 1: Japanese Unexamined Patent Publication No. 10-220816

SUMMARY OF INVENTION

Technical Problem

However, in a case where a large number of outdoor units are stored, the outdoor units are not only set closely to each other in the horizontal direction but sometimes piled up and stacked on one another. In this case, a large load acts on the top plate of the outdoor unit on the lower side. Thus, in order to prevent damage or deformation of the top plate, there is a need for arranging a thick buffer member between the upper and lower outdoor units, so that a cost increase is caused.

The present invention is achieved in consideration with the situation described above, and an objective thereof is to provide an outdoor unit of an air conditioning device capable of simplifying a buffer member used at the time of storage of the outdoor unit so as to reduce storage cost.

Solution to Problem (1) An outdoor unit of an air conditioning device (hereinafter, also simply referred to as the "outdoor unit") of the present invention is an outdoor unit of an air conditioning device in which a compressor, a heat exchanger, and a fan are accommodated in a casing including a top plate, side plates, and a bottom plate, wherein the top plate is formed in a rectangular shape, a flat mount surface is formed in each of corner portions of the top plate, regarding each of sides of the top plate, an intermediate part excluding the corner portions serves as a retreat portion set back to the side of the device, and an end of the retreat portion and the mount surface are connected by a standing surface.

In the outdoor unit of the present invention, the retreat portion set back to the side of the device is provided in the intermediate part of each of sides of the top plate. Therefore, by forming an insertion hole for a screw or a bolt in such a retreat portion and fixing the top plate by using this insertion hole, even in a case where a plurality of outdoor units are arranged closely to each other at the time of transportation and the time of storage, a head part of the screw or the bolt is not butted with the adjacent outdoor unit between the adjacent outdoor units. The flat mount surface is formed in each of the corner portions of the top plate, and the end of the retreat portion and the mount surface are connected by the standing surface. Therefore, even in a case where the plurality of outdoor units are stacked and stored, a load from the outdoor unit on the upper side can be received by the flat mount surface, and withstand load of the mount surface can be increased by the standing surface functioning as a rib. Thus, a buffer member can be simplified and formed in an uncomplicated shape. As a result, cost of the buffer member can be reduced, so as to reduce storage or transportation cost of the outdoor unit.

(2) In the above outdoor unit of (1), the retreat portion can include an inclined surface. In this case, by forming an insertion hole for a screw or a bolt in the inclined surface and fixing the top plate by using this insertion hole, a head part of the screw or the bolt can be prevented from being butted with the casing or the like of the adjacent outdoor unit at the time of transportation and the time of storage.

(3) In the above outdoor unit of (1) or (2), preferably, the standing surface is a surface substantially vertical to the mount surface. In this case, by the standing surface substantially vertical to the mount surface, the withstand load of the mount surface can be effectively increased.

(4) In the above outdoor unit of (1) to (3), preferably, a recess for a ventilating hole is formed in the top plate, and an upper end surface of a grille arranged in the ventilating hole of a bottom portion of the recess is flush with a surface of the top plate or placed on the lower side of the surface of the top plate. In this case, since an upper surface of the grille does not protrude from the surface of the top plate, a shape of a buffer member used in a case where the outdoor units are stacked can be simplified.

(5) In the above outdoor unit of (2) to (4), an insertion hole for a screw or a bolt may be formed in the inclined surface. In this case, a head part of the screw or the bolt can be prevented from being butted with the casing or the like of the adjacent outdoor unit.

Advantageous Effects of Invention

According to the outdoor unit of the air conditioning device of the present invention, a buffer member used at the time of storage of the outdoor unit can be simplified so as to reduce storage cost.

DESCRIPTION OF EMBODIMENTS

Hereinafter, an embodiment of an outdoor unit of the present invention will be described in detail with reference to the attached drawings.

Figure 1:
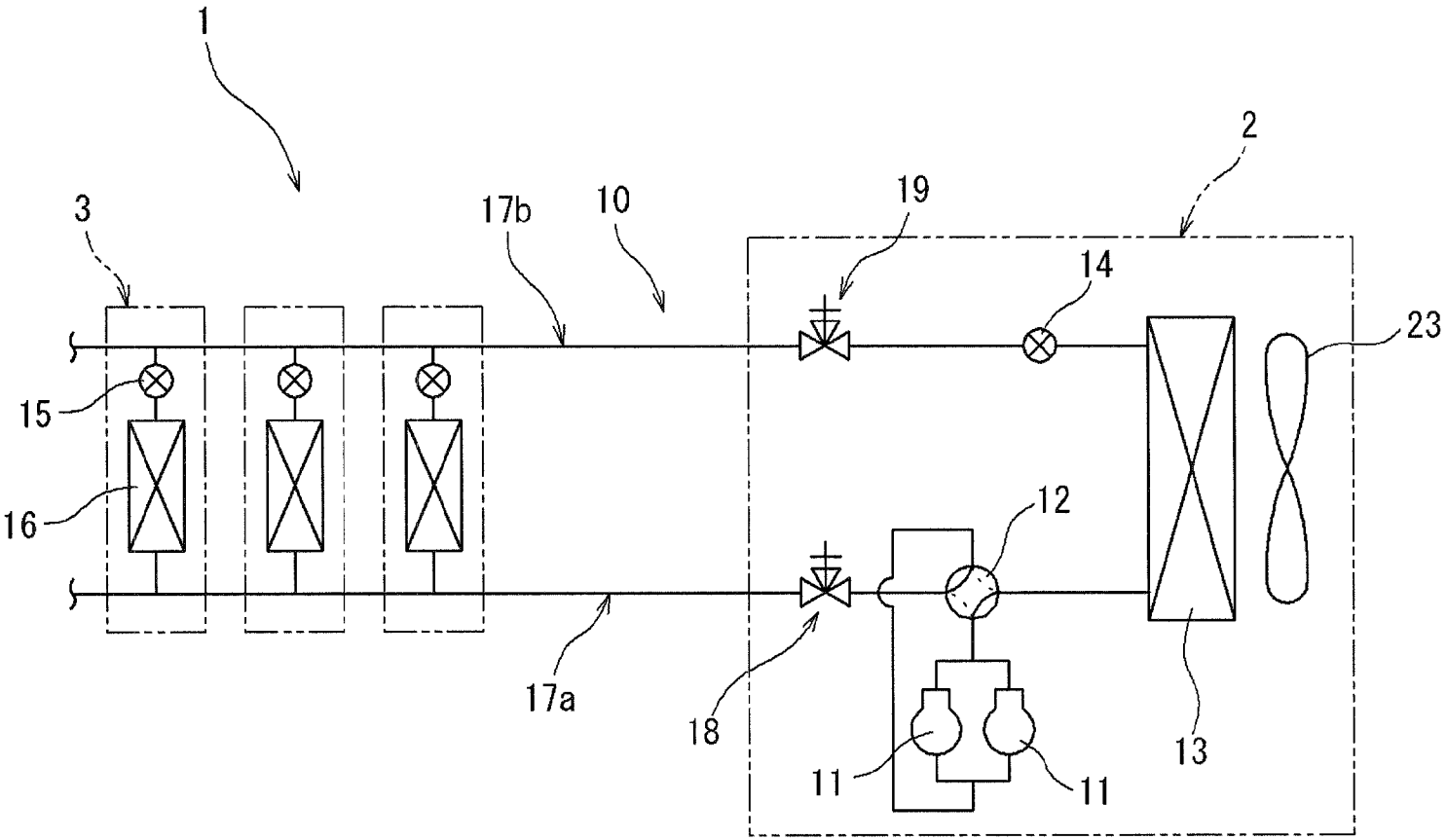
FIG. 1 is a pattern diagram showing a refrigerant circuit of an air conditioning device having an outdoor unit according to one embodiment of the present invention.

FIG. 1 is a pattern diagram showing a refrigerant circuit of an air conditioning device 1 having an outdoor unit 2 according to one embodiment of the present invention. The air conditioning device 1 is for example a multiple type air conditioning device for a building in which a refrigerant circuit 10 is formed in such a manner that a plurality of indoor units 3 are connected in parallel to one or a plurality of outdoor units 2 so as to circulate a refrigerant.

In the outdoor unit 2, compressors 11, a four way valve 12, an outdoor heat exchanger 13, an outdoor expansion valve 14, fans 23, and the like are provided. In the indoor unit 3, an indoor expansion valve 15, an indoor heat exchanger 16, and the like are provided. The four way valve 12 and the indoor heat exchanger 16 are connected by a gas side refrigerant communication pipe 17*a*, and the outdoor expansion valve 14 and the indoor expansion valve 15 are connected by a liquid side refrigerant communication pipe 17*b*. A gas side stop valve 18 and a liquid side stop valve 19 are provided in terminal portions of the inside refrigerant circuit of the outdoor unit 2. The gas side stop valve 18 is arranged on the side of the four way valve 12, and the liquid side stop valve 19 is arranged on the side of the outdoor expansion valve 14. The gas side refrigerant communication pipe 17*a* is connected to the gas side stop valve 18, and the liquid side refrigerant communication pipe 17*b* is connected to the liquid side stop valve 19.

In the outdoor unit 2 of the present embodiment, the two compressors 11 are provided in parallel. The two compressors 11 may be combination of a variable-capacity inverter compressor for performing speed control by an inverter and a constant-capacity compressor of constant capacity for performing on-off control, or may be combination of two inverter compressors having the same capacity or different capacities or combination of two constant-capacity compressors.

In a case where a cooling operation is performed in the air conditioning device 1 with the above configuration, the four way valve 12 is retained in a state shown by solid lines in FIG. 1. A high temperature and high pressure gas refrigerant discharged from the compressors 11 flows into the outdoor heat exchanger 13 via the four way valve 12, and performs heat exchange with the outdoor air by actuation of the fans 23 so as to be condensed and liquefied. The liquefied refrigerant passes through the outdoor expansion valve 14 in a fully open state, and flows into the indoor units 3 through the liquid side refrigerant communication pipe 17*b*. In the indoor unit 3, pressure of the refrigerant is reduced to predetermined low pressure by the indoor expansion valve 15, and further, the refrigerant performs the heat exchange with the indoor air in the indoor heat exchanger 16 so as to be evaporated. The indoor air cooled by evaporation of the refrigerant is blown out to an interior by an indoor fan (not shown) so as to cool the interior. The refrigerant evaporated and gasified in the indoor heat exchanger 16 is returned to the outdoor unit 2 through the gas side refrigerant communication pipe 17*a*, and suctioned into the compressors 11.

Meanwhile, in a case where a heating operation is performed, the four way valve 12 is retained in a state shown by broken lines in FIG. 1. A high temperature and high pressure gas refrigerant discharged from the compressors 11 flows into the indoor heat exchanger 16 of the indoor unit 3 via the four way valve 12, and performs the heat exchange with the indoor air so as to be condensed and liquefied. The indoor air heated by condensation of the refrigerant is blown out to the interior by the indoor fan so as to heat the interior. The refrigerant liquefied in the indoor heat exchanger 16 is returned to the outdoor unit 2 from the indoor expansion valve 15 in a fully open state through the liquid side refrigerant communication pipe 17*b*. The pressure of the refrigerant returned to the outdoor unit 2 is reduced to predetermined low pressure by the outdoor expansion valve 14, and further, the refrigerant performs the heat exchange with the outdoor air in the outdoor heat exchanger 13 so as to be evaporated. The refrigerant evaporated and gasified in the outdoor heat exchanger 13 is suctioned into the compressors 11 via the four way valve 12.

Figure 2:
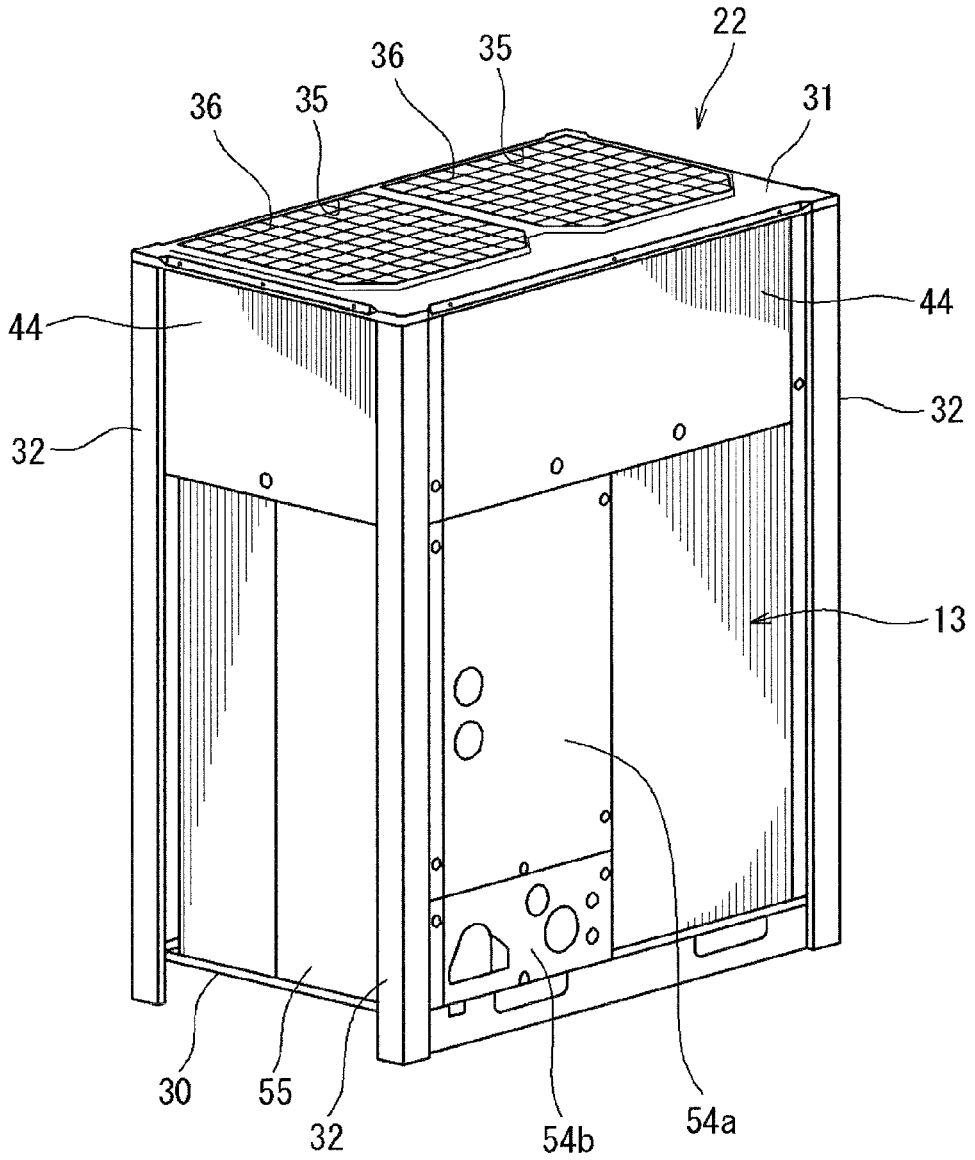
FIG. 2 is a perspective view of the embodiment of the outdoor unit of the present invention.
Figure 3:
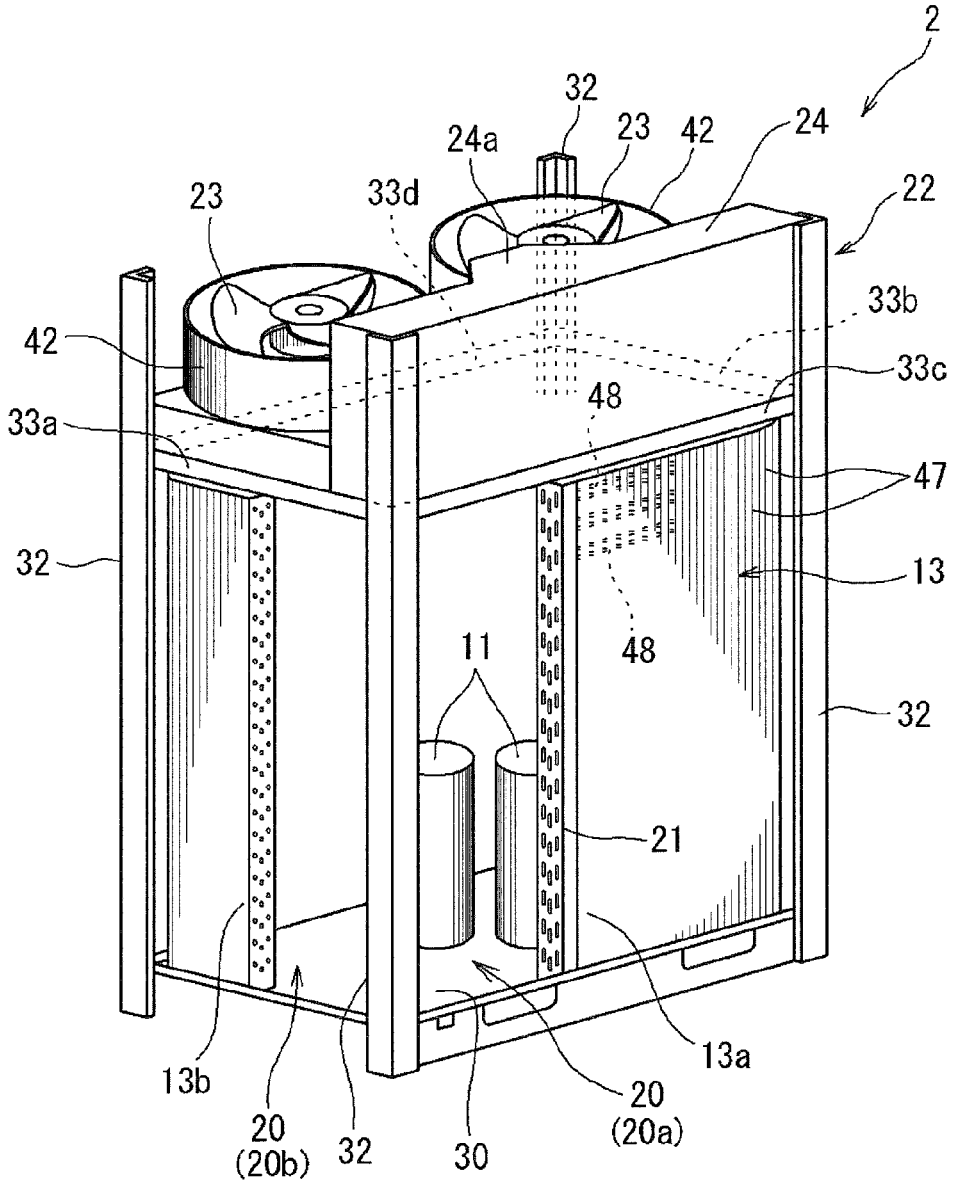
FIG. 3 is a perspective view showing a state where a top plate and side plates of the outdoor unit shown in FIG. 2 are removed.
Figure 4:
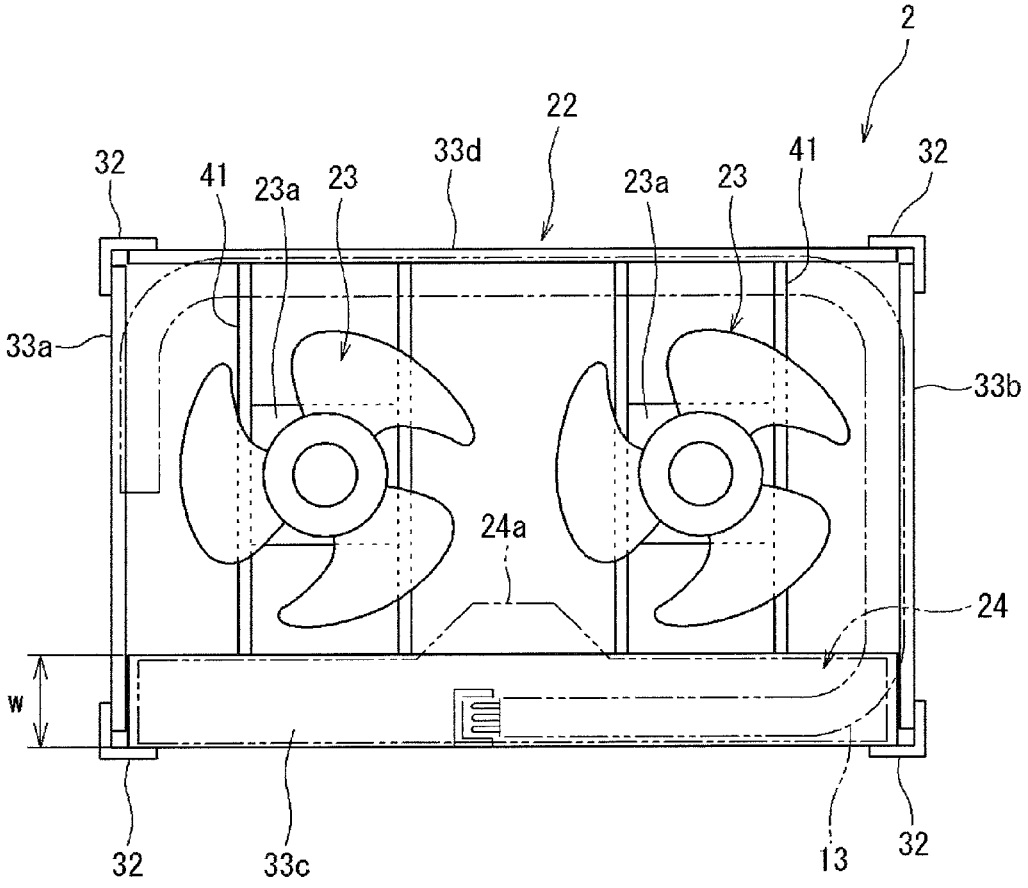
FIG. 4 is an illustrative plan view showing the upper part side inside the outdoor unit shown in FIG. 2.

FIG. 2 is a perspective view of the embodiment of the outdoor unit of the present invention, FIG. 3 is a perspective view showing a state where a top plate and side plates of the outdoor unit shown in FIG. 2 are removed, and FIG. 4 is an illustrative plan view showing the upper part side inside the outdoor unit shown in FIG. 2.

The outdoor unit 2 has a casing 22, and the outdoor heat exchanger 13 arranged along side surfaces of this casing 22. The casing 22 is formed in a substantially rectangular parallelepiped shape by a steel plate or the like, and includes a bottom plate 30, a top plate 31, support pillars 32, lateral members 33*a* to 33*d*, side plates 44, 54, and 55, and the like.

As shown in FIGS. 2 and 3, the bottom plate 30 is formed in a square shape in a plan view and in particular, an oblong shape elongated in the left and right direction. Lower parts of the support pillars 32 are respectively coupled to four corners of the bottom plate 30 by coupling tools such as bolts. The support pillar 32 is formed by for example a substantially L shape angle bar to be fitted to a shape of a corner part of the bottom plate 30.

As shown in FIG. 2, the top plate 31 is formed in a square shape in a plan view which is the substantially same as the bottom plate 30, and arranged so as to have a gap above the bottom plate 30. Upper ends of the support pillars 32 are coupled to four corners of the top plate 31 by coupling tools such as bolts. Two square ventilating holes 35 are formed side by side in the left and right direction in the top plate 31, and grilles 36 for preventing invasion of foreign substances are provided in the ventilating holes 35.

As shown in FIG. 3, the lateral members 33*a* to 33*d* are arranged on the upper part side of the support pillars 32 at positions having a predetermined gap downward from the top plate 31, and bridged between the support pillars 32 adjacent to each other in the front and rear direction and the left and right direction. A framework of the casing 22 is formed by structural members including the support pillars 32 and the lateral members 33*a* to 33*d*. The bottom plate 30, the top plate 31, and the side plates 44, 54, and 55 are attached to this framework by screws and bolts. A cover member 21 to be described later (refer to FIG. 3) also serves as a structural member (strength member) forming the framework of the casing 22.

As shown in FIG. 4, the lateral members 33*a* and 33*b* arranged on both the left and right sides of the casing 22, and the lateral member 33*d* arranged on the rear part side of the casing 22 are formed by a thin and long member having a rectangular or L shape section. Meanwhile, the lateral member (front lateral member) 33*c* arranged on the front part side of the casing 22 is formed by a plate material whose width w in the front and rear direction is formed to be slightly wide. An electric component unit 24 is arranged on this front lateral member 33*c*. That is, the front lateral member 33*c* is used as a support base of the electric component unit 24. The electric component unit 24 accommodates a control board for controlling the entire outdoor unit 2, an inverter board for controlling the compressors, and other electric parts inside a box shape casing. The electric component unit 24 is provided in a wide range occupying all or almost all the width in the left and right direction of the outdoor unit 2.

Two support bases 41 are bridged side by side in the left and right direction between the front lateral member 33*c* and the rear lateral member 33*d*. Motors 23*a* of the fans 23 are supported on the support bases 41. As shown in FIG. 3, bell mouths 42 surrounding outer circumferences of the fans 23 and forming ventilating routes are attached to the lateral members 33*a* to 33*d*. The electric component unit 24 has a protruding portion 24*a* protruding into a dead space between the two left and right fans 23 (between the bell mouths 42) in a center part in the left and right direction thereof. By this protruding portion 24*a*, inside capacity of the electric component unit 24 is increased.

As shown in FIG. 2, the upper part side plates 44 are provided on the four side surfaces of the casing 22 positioned between the lateral members 33*a* to 33*d* and the top plate 31. The fans 23, the bell mouths 42, and the electric component unit 24 (refer to FIG. 3) are covered by the upper part side plates 44 and the top plate 31 so as not to be exposed to an exterior. The upper part side plate 44 on a front surface may form a lid member for openably closing a front surface part of the electric component unit 24.

Figure 5:
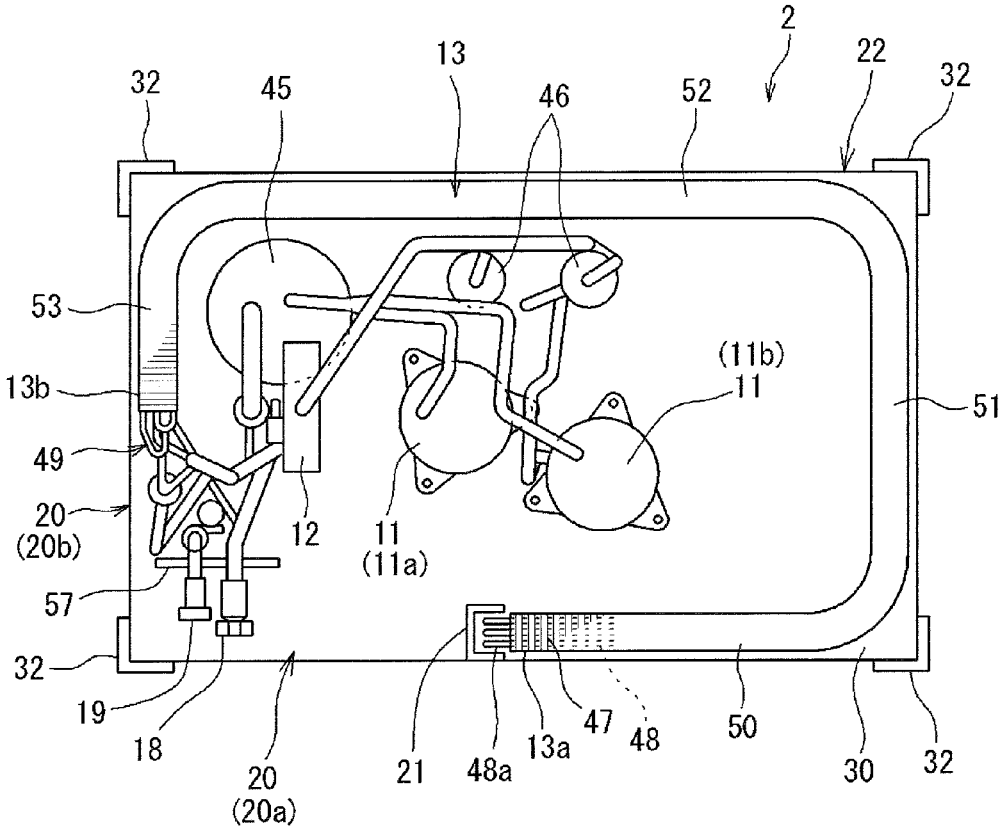
FIG. 5 is an illustrative plan view showing the lower part side inside the outdoor unit shown in FIG. 2.

FIG. 5 is an illustrative plan view showing the lower part side inside the outdoor unit shown in FIG. 2. The devices such as the outdoor heat exchanger 13, the compressors 11, an accumulator 45, and oil separators 46 are mounted on an upper surface of the bottom plate 30 of the casing 22. The outdoor heat exchanger 13 is a fin and tube type heat exchanger of a so-called cross fin type, including a large number of aluminum fins 47 and copper heat transfer tubes 48. The heat transfer tubes 48 form a refrigerant flow passage for circulating the refrigerant while performing the heat exchange with the air, and the plurality of heat transfer tubes 48 are provided in line in the up and down direction. The heat transfer tubes 48 pass through the plurality of fins 47 in an orthogonal manner, and are bent by 180 degrees in a U shape in side end portions on both sides of the outdoor heat exchanger 13 so as to extend in a zigzag manner. Only the U shape bent heat transfer tubes 48 (U shape pipes 48*a*) protrude in a one side end portion 13*a* of the outdoor heat exchanger 13, and ends of the heat transfer tubes 48 connected to a pipe group 49 including a capillary tube and a header tube in addition to the U shape bent heat transfer tubes 48 protrude in the other side end portion 13*b*.

The outdoor heat exchanger 13 is bent in a substantially square shape along the four side surfaces of the casing 22. Specifically, the outdoor heat exchanger 13 has a front heat exchange portion 50 along the side surface on the front side of the casing 22 (front surface), a right heat exchange portion 51 along the side surface on the right side, a rear heat exchange portion 52 along the side surface on the rear side (rear surface), and a left heat exchange portion 53 along the side surface on the left side. A part between the front heat exchange portion 50 and the right heat exchange portion 51, a part between the right heat exchange portion 51 and the rear heat exchange portion 52, and a part between the rear heat exchange portion 52 and the left heat exchange portion 53 are bent at 90 degrees or at an angle close to 90 degrees. In the present embodiment, a left end of the front heat exchange portion 50 forms the one side end portion 13*a* of the outdoor heat exchanger 13, and a front end of the left heat exchange portion 53 forms the other side end portion 13*b*.

The front heat exchange portion 50 is provided along a substantially right half range in the front surface of the casing 22. The left heat exchange portion 53 is provided along a substantially rear half range in the left side surface of the casing 22. Therefore, between the one side end portion 13*a* of the outdoor heat exchanger 13 and the other side end portion 13*b*, that is, in a left half of the front surface of the casing 22 and a front half of the left side surface, an opening portion 20 where the outdoor heat exchanger 13 does not exist is formed.

As shown in FIGS. 2 and 3, the opening portion 20 is divided into two by the support pillar 32. An opening portion 20*a* on the front surface of the casing 22 is closed by front side plates 54*a* and 54*b*, and an opening portion 20*b* on the left side surface of the casing 22 is closed by the left side plate 55. By removing the front side plates 54*a* and 54*b* and the left side plate 55, the opening portions 20*a* and 20*b* are opened, so that an interior and an exterior of the outdoor unit main body 22 can communicate with each other. It should be noted that in FIG. 2, a side surface part of the outdoor unit main body 22 other than the upper part side plates 44, the front side plates 54*a* and 54*b*, and the left side plate 55 is not provided with a side plate, and the outdoor heat exchanger 13 is exposed as it is. However, a side plate in which a ventilating hole for allowing circulation of the air is formed, or a grid shape member in which a plurality of wire rods are assembled in a grid shape may be provided in the side surface part of the outdoor unit main body 22 facing the outdoor heat exchanger 13.

As shown in FIG. 5, the stop valves 18 and 19 are supported via a bracket 57 so as to face the opening portion 20*a* on the front surface of the casing 22. The pipe group 49 is arranged in the vicinity of the opening portion 20*b* on the left side surface. The compressor 11*a* arranged on the left side of the two compressors 11 is arranged at such a position that the substantially entire compressor can be visually recognized from the front side via the opening portion 20*a* on the front surface. The compressor 11*b* arranged on the right side is arranged at such a position that the compressor comes in to the slightly right side of the opening portion 20*a*. The accumulator 45 and the oil separators 46 are arranged on the rear part side in the casing 22.

The devices such as the compressors 11 and the valves arranged inside the casing 22 are subjected to regular inspection and maintenance, and these tasks can be performed via the opening portion 20. A replacement task of the devices arranged in the casing 22 can also be performed via the opening portion 20. At the time of performing these tasks, when a tool to be used for the maintenance or the like and the devices and the like to be replaced are brought into contact with the U shape tubes 48*a* protruding from the side end portion 13*a* of the outdoor heat exchanger 13, there is a fear that the U shape tubes 48*a* are damaged. Thus, the cover member 21 for covering the U shape tubes 48*a* is provided in the outdoor unit 2 of the present embodiment, and the U shape tubes 48*a* are protected by this cover member 21.

Figure 6:
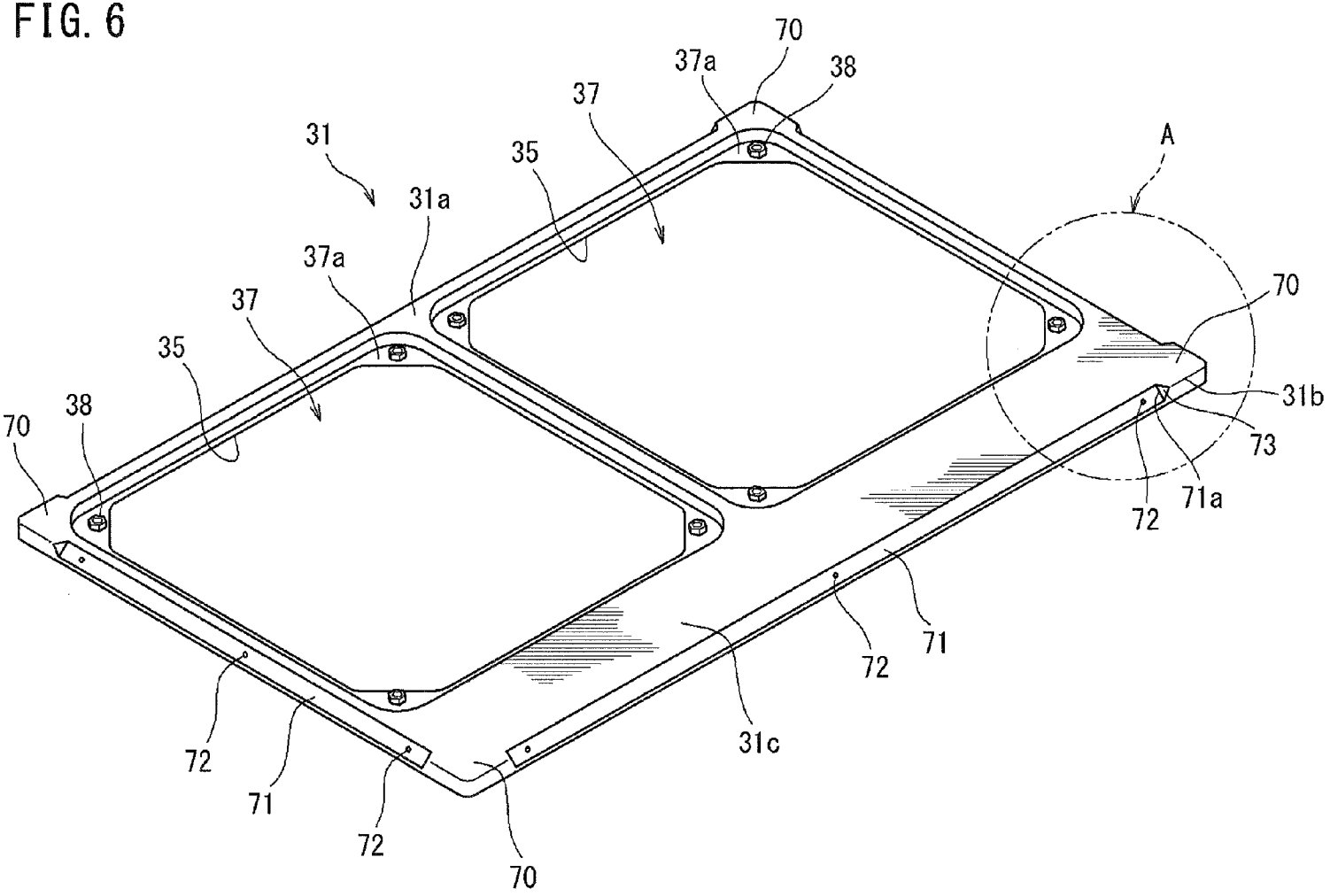
FIG. 6 is a perspective view of the top plate in the outdoor unit shown in FIG. 2.
Figure 7:
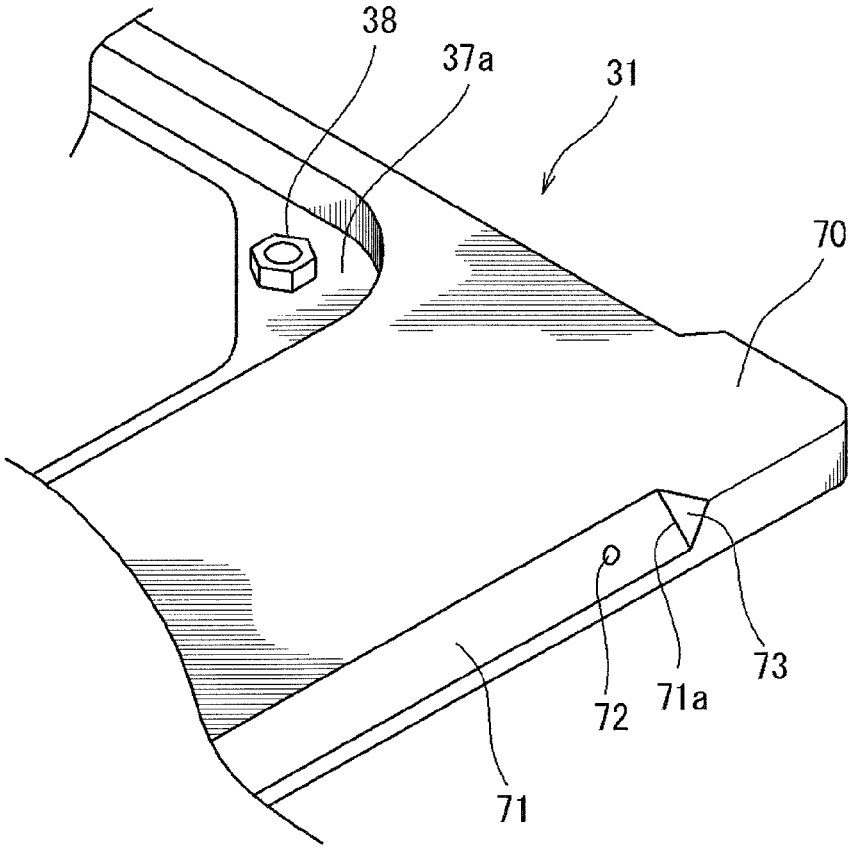
FIG. 7 is an enlarged view of a part (corner portion) shown by the reference sign A in FIG. 6.

The outdoor unit 2 of the present invention is characterized by a structure of the top plate 31 forming the above casing 22. FIG. 6 is a perspective view of the top plate 31 in the outdoor unit 2 shown in FIG. 2, and FIG. 7 is an enlarged perspective view of a corner portion of the top plate 31 shown in FIG. 6 (corner portion shown by the reference sign A in FIG. 6).

As shown in FIG. 6, the top plate 31 of the present embodiment is formed in a rectangular shape which is thin and long in the left and right direction, and two square ventilating holes 35 are formed side by side in the left and right direction in the top plate 31. The ventilating holes 35 are formed in bottom portions 37*a* of recesses 37 having the bottom portions 37*a* slightly lower than a surface 31*a* of the top plate 31. Nuts 38 are secured to four corners of each of the bottom portions 37*a*, and each of the grilles 36 is arranged in the recess 37 by using the nuts 38 and bolts (not shown).

Flat mount surfaces 70 are formed in the four corners of the top plate 31. Regarding each of sides of the top plate 31, an intermediate part excluding the corner portions of the top plate 31, in other words, a part between the mount surfaces 70 on both ends of the side is an inclined surface 71 serving as a retreat portion. This "retreat portion" is a part whose surface is set back to the device interior side from edges 31*b* of the corner portions of the top plate 31 as shown in FIG. 6. A space formed by this set-back is not butted with the closely-set other outdoor unit.

Insertion holes 72 for screws are formed on the inclined surface 71 at predetermined intervals, and the top plate 31 is attached to an upper edge of the upper part side plate 44 with the screws (not shown) by utilizing the insertion holes 72. It should be noted that the upper edge of the upper part side plate 44 is bent inward in correspondence with inclination of the inclined surface 71. Head parts of the screws are placed in the set-back space. Thus, even in a case where the plurality of outdoor units are transported and stored in a closely-set manner, the head parts of the screws are not butted with the casing of the adjacent outdoor unit. Therefore, there is no need for using a buffer member having a part of absorbing the head parts of the screws unlike the conventional example. Thus, the buffer member can be simplified and formed in an uncomplicated shape.

The mount surface 70 formed in each of the corner portions of the top plate 31, and an end 71*a* of the inclined surface 71 are connected by a standing surface including a substantially triangle vertical surface 73. The flat mount surface 70 can receive a load in the vertical direction and the vertical surface 73 functions as a rib. Thus, withstand load of the top plate 31 can be increased. Therefore, even in a case where the plurality of outdoor units are stacked and stored, there is no need for using such a thick buffer member as the conventional example, so that the buffer member can be simplified and formed in an uncomplicated shape. As a result, cost of the buffer member can be reduced, so that storage cost of the outdoor unit can be reduced.

In the present embodiment, a wide portion 31*c* is formed on the front side of the top plate 31, so that strength of the entire top plate 31 is enhanced. Therefore, a handling property of the top plate 31 at the time of setting up the outdoor unit 2 is improved.

OTHER MODIFIED EXAMPLES

Figure 8:
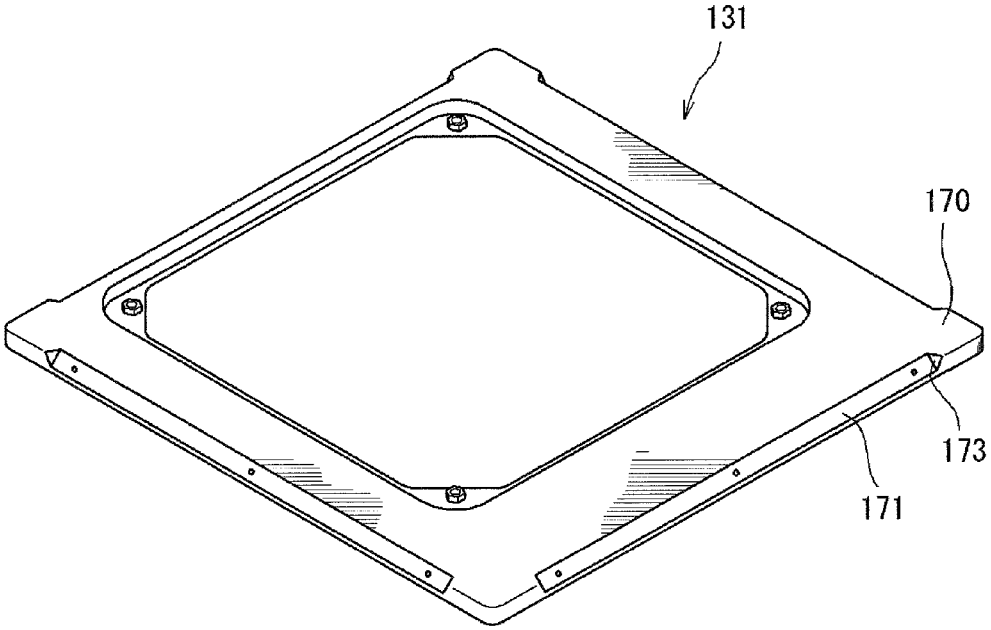
FIG. 8 is a perspective view of another example of the top plate.

It should be noted that the present invention is not limited to the above embodiment but can be variously changed within the scope described in the claims. For example, the two compressors and the two fans are accommodated in one outdoor unit in the above embodiment. However, the number of the compressors and the number of the fans are not particularly limited in the present invention but can be appropriately selected in accordance with the use. For example, as a top plate in a case of one fan, a top plate shown in FIG. 8 can be used. In the top plate 131 shown in FIG. 8, a flat mount surface 170 is also formed in each of corner portions, and an inclined surface 171 is formed in an intermediate part of each of sides of the top plate 131. An end of the inclined surface 171 and the mount surface 170 are connected by a substantially triangle vertical surface 173.

Figure 9:
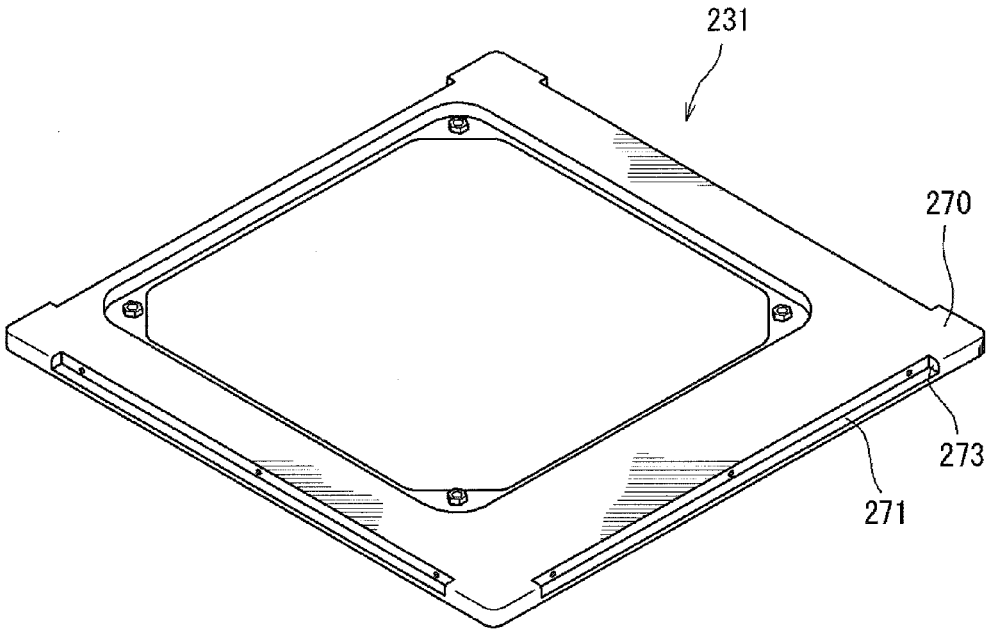
FIG. 9 is a perspective view of further another example of the top plate.

In the above embodiment, the inclined surface is adopted as the retreat portion. However, as long as butting of the head part of the screw or the like can be prevented, for example, such a shoulder portion or a step portion 271 as shown in FIG. 9 can also serve as the retreat portion. In a top plate 231 shown in FIG. 9, a substantially square vertical surface 273 is adopted as a standing surface for connecting an end of the retreat portion and a mount surface 270 formed in a corner portion.

Figure 10A:
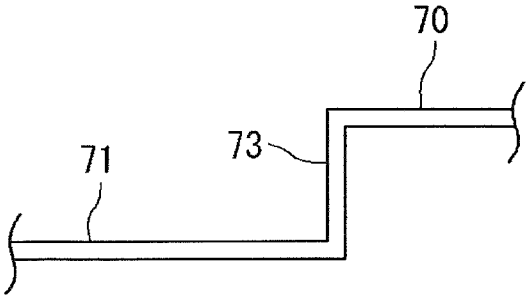
FIGS. 10A to 10C are illustrative sectional views of a standing surface in the outdoor unit of the present invention.
Figure 10B:
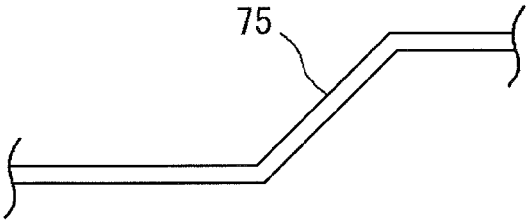
Figure 10C:
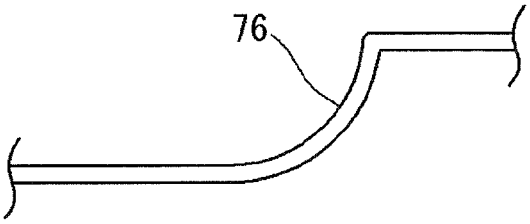

In the above embodiment, the vertical surface 73 substantially vertical to the mount surface 70 as shown in an illustrative sectional view of FIG. 10A serves as the standing surface. However, in addition to this, an inclined surface 75 shown in FIG. 10B and a curved surface 76 shown in FIG. 10C can also serve as the standing surface. In these cases, the inclined surface 75 and the curved surface 76 function as a rib and contribute to an increase in withstand load of the mount surface.

REFERENCE SIGNS LIST

1: AIR CONDITIONING DEVICE
2: OUTDOOR UNIT

3: INDOOR UNIT
10: REFRIGERANT CIRCUIT
11: COMPRESSOR
13: OUTDOOR HEAT EXCHANGER
22: CASING
30: BOTTOM PLATE
31: TOP PLATE
32: SUPPORT PILLAR
33: LATERAL MEMBER
35: VENTILATING HOLE
36: GRILLE
44: SIDE PLATE
54: SIDE PLATE
55: SIDE PLATE
70: MOUNT SURFACE
71: INCLINED SURFACE
73: VERTICAL SURFACE (STANDING SURFACE)
131: TOP PLATE
170: MOUNT SURFACE
171: INCLINED SURFACE
173: VERTICAL SURFACE (STANDING SURFACE)
231: TOP PLATE
270: MOUNT SURFACE
271: SHOULDER PORTION
273: VERTICAL SURFACE (STANDING SURFACE)

The invention claimed is:

1. An outdoor unit of an air conditioning device in which a compressor, a heat exchanger, and a fan are accommodated in a casing including a top plate, side plates, and a bottom plate, wherein the top plate is formed in a rectangular shape, a flat mount surface is formed in each of corner portions of the top plate, an upper end of a support pillar serving as a structural member of the casing is coupled to each of corner portions of the top plate, at each of the sides of the top plate, an intermediate part excluding the corner portions serves as a retreat portion set back to the side of the device, an insertion hole for a screw or a bolt for casing assembly is formed in the retreat portion, and an end of the retreat portion is connected to the mount surface of one of the adjacent corner portions by a standing surface.

2. The outdoor unit of the air conditioning device according to claim 1, wherein the retreat portion includes an inclined surface.

3. The outdoor unit of the air conditioning device according to claim 1, wherein the standing surface is a surface substantially perpendicular to the mount surface of the adjacent corner.

4. The outdoor unit of the air conditioning device according to claim 1, wherein a recess for a ventilating hole is formed in the top plate, and an upper end surface of a grille arranged in the ventilating hole of a bottom portion of the recess is flush with a surface of the top plate or placed on the lower side of the surface of the top plate.

5. The outdoor unit of the air conditioning device according to claim 2, wherein the insertion hole for a screw or a bolt is formed in the inclined surface.

* * * * *